United States Patent [19]

Bosshold

[11] 4,057,168

[45] Nov. 8, 1977

[54] VENTED TEST TUBE TOP

[76] Inventor: Barry L. Bosshold, 115 Shelter Lagoon Drive, Santa Cruz, Calif. 95060

[21] Appl. No.: 593,328

[22] Filed: July 7, 1975

[51] Int. Cl.[2] ..... B65D 51/16; B65D 51/18

[52] U.S. Cl. ..... 220/209; 215/235; 215/260; 215/306; 215/311; 215/329; 220/255; 220/303; 220/373; 220/375

[58] Field of Search ..... 220/202, 209, 207, 303, 220/23.4, 374, 373, DIG. 19, 339, 375, 337, 334, 255, 220/203; 215/307, 260, 311, 329, 321, 306, 215/235, 137/494, 525, 525.3, 137/855; 859, 222/547, 545, 538; 429/82, 83, 89

[56] References Cited

U.S. PATENT DOCUMENTS

| | | | |
|---|---|---|---|
| 601,698 | 4/1898 | Bachans | 220/DIG. 19 |
| 1,724,346 | 8/1929 | Ford | 220/303 |
| 2,202,653 | 5/1940 | Glidden | 220/303 |
| 2,424,801 | 7/1947 | Crabbe et al. | 215/311 |
| 2,570,123 | 10/1951 | Heine | 220/255 |
| 2,638,127 | 5/1953 | Griswold | 137/859 |
| 2,754,962 | 7/1956 | Scrymgfour | 220/23.4 |
| 2,816,681 | 12/1957 | Taylor | 220/374 |
| 3,072,284 | 1/1963 | Luhman | 220/374 |
| 3,105,507 | 10/1963 | Dunmire | 137/859 |
| 3,115,155 | 12/1963 | Clark | 137/525.3 |
| 3,164,279 | 1/1965 | Towns | 215/307 |
| 3,262,612 | 7/1966 | Tabor | 222/547 |
| 3,288,320 | 11/1966 | Swanson | 215/321 |
| 3,292,658 | 12/1966 | Scaramucci | 220/334 |
| 3,297,184 | 1/1967 | Andelin | 215/307 |
| 3,337,082 | 8/1967 | Dorgelys | 220/23.4 |
| 3,365,105 | 1/1968 | Krizka | 137/853 |
| 3,384,113 | 5/1968 | Pennisi | 137/525 |
| 3,490,488 | 1/1970 | Grist | 137/525 |
| 3,595,429 | 7/1971 | Kohen | 220/203 |
| 3,595,445 | 7/1971 | Baford et al. | 251/342 |
| 3,799,299 | 3/1974 | Cohen | 137/525.3 |
| 3,883,030 | 5/1975 | Mathews et al. | 220/375 |

FOREIGN PATENT DOCUMENTS

| | | | |
|---|---|---|---|
| 1,036,861 | 9/1953 | France | 222/543 |
| 557,118 | 5/1957 | France | 137/525.3 |

*Primary Examiner*—William Price
*Assistant Examiner*—Allan N. Shoap
*Attorney, Agent, or Firm*—Melvin R. Stidham

[57] ABSTRACT

A vented top for a bacteria culture medium tube having a body with through openings to hold one or more tubes simultaneously. A cap closes off all openings or opens them together. Vent means enable automatic venting of gases generated by the bacteria.

5 Claims, 6 Drawing Figures

VENTED TEST TUBE TOP

BACKGROUND OF THE INVENTION

In certain phases of diagnostic research, a pure culture of bacteria is introduced by means of a needle into various media contained in tubes. According to present practice, a tube is held in one hand while removing the screw top with the other. Then, a needle with the bacteria on it is grasped and introduced into the tube. After the needle is withdrawn, the screw top is replaced loosely to allow venting of the gases which are generated by the bacterial action on the media inside the tube. Then the tube is racked and the process of grasping a tube, removing the top, introducing the bacteria and replacing the top, remembering to allow for venting, is repeated for each of the two or more media into which the bacteria is to be introduced.

OBJECTS OF THE INVENTION

It is an object of my invention to provide a top for test media tube which will hold two or more tubes together in a single unit.

It is a further object of my invention to provide a top for a test media tube which may be sealed tightly prior to use but automatically vented after introduction of a bacteria culture for release of gas.

It is a further object of my invention to provide a top for tubes which will cover or uncover all tubes of a group together.

It is a further object of my invention to provide a top for a tube which may be conveniently opened and closed with one hand.

BRIEF SUMMARY OF THE INVENTION

DESCRIPTION OF PREFERRED EMBODIMENTS

Figure 2:
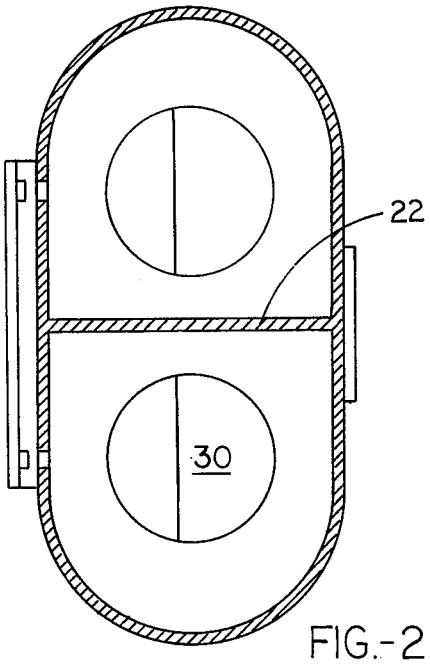
FIG. 2 is a horizontal section view taken along line 2—2 of FIG. 1.
Figure 1:
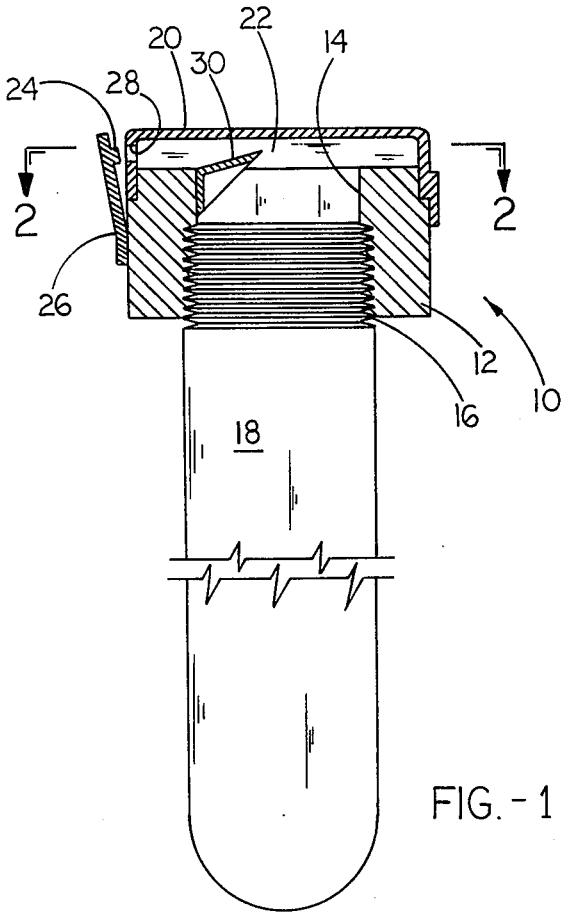
FIG. 1 is a section view of a cap embodying features of this invention.

The Embodiment of FIGS. 1 and 2

Referring now to FIGS. 1 and 2 with greater particularity, the media tube top 10 of this invention may comprise a body portion 12 with one or more openings 14 therethrough. As shown in FIG. 1, the openings are tapped at 16 to threadedly receive a top of a test tube 18. It is understood, however, that the threading is shown merely by way of illustration as appropriate to a conventional known test tube and any other form of gripping means, such as a snap fit, may be substituted therefor.

A cap 20 is carried on the body as by hinge connection at 22 whereby, when closed, the cap fits snugly around the body 12 in sealing relationship thereto. Where two or more openings 14 are provided in the body, there is also preferably provided a barrier or wall 22 between the openings which is engaged by the cap 20 in closed position whereby the test tubes 18 are sealed from each other.

When the cap is closed prior to use, plugs 24 which may be carried on a lock flap 26 hinged to the body 12 are inserted in vent ports 28 in the cap opposite each opening, whereby the media contained in the tube 18 is protected from intrusion of foreign matter, and from drying out during storage. However, when the bacteria is to be added to the medium in the tube 18, and the latch 26 is released to open the cap 20, the vent holes 28 are automatically unplugged. Then, when the cap is again closed, the flap is simply not latched, whereby the vent holes 28 are left unplugged, allowing gases which are inevitably generated to escape. There is preferably provided a cowling or deflector 30 to extend partially across the opening 14 to restrain the escape of the liquid or gelatinous media within the tube 18 along with the gases so generated.

Figure 3:
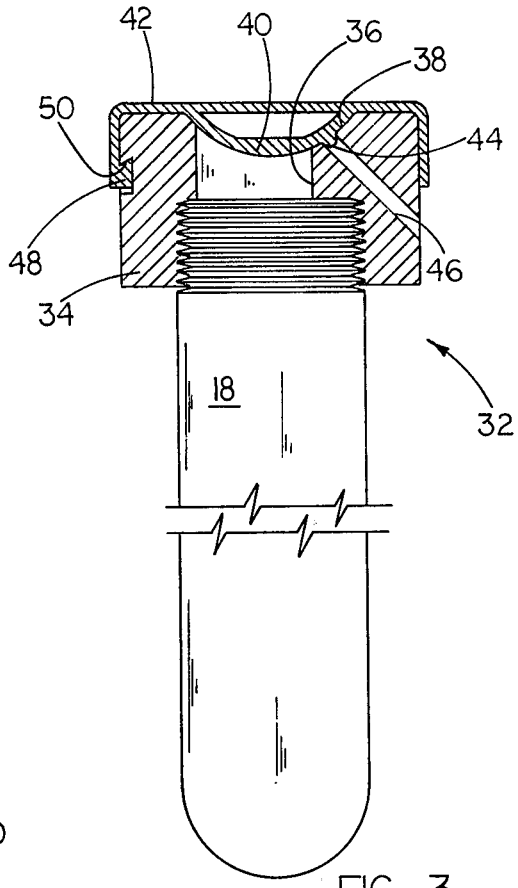
FIG. 3 is a vertical section view of another embodiment of my invention.

The Embodiment of FIG. 3

In FIG. 3, the top 32 has a body 34 with similar openings 36 formed therethrough. The openings are surrounded by a depressed sealing surface 38 which is normally engaged by a sealing diaphragm member 40 carried on the cap 42. However, when gases are generated, the diaphragm 40 is forced by the increased pressure to become unseated, allowing a plug 44 to be removed from a vent passageway 46 and permit escape of the gases therethrough. Upon relieving the gas pressure, the diaphragm portions may again be extended to the sealing position shown. Hence, the diaphragm member functions as a oneway check valve which permits the escape of gases but prevents the intrusion of impurities. The cap 42 is locked in sealed positions by means of a suitable catch 48 engaging on a lip 50 on the body 34.

Figure 5:
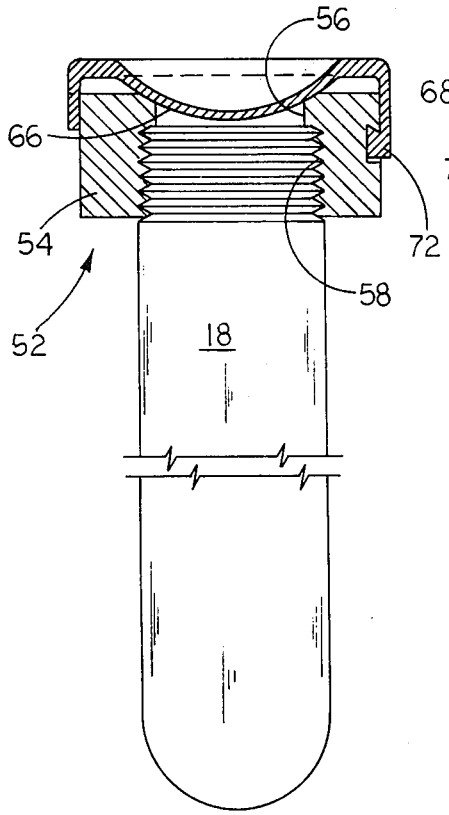
FIG. 5 is a section view taken along line 5—5 of FIG. 4.
Figure 4:
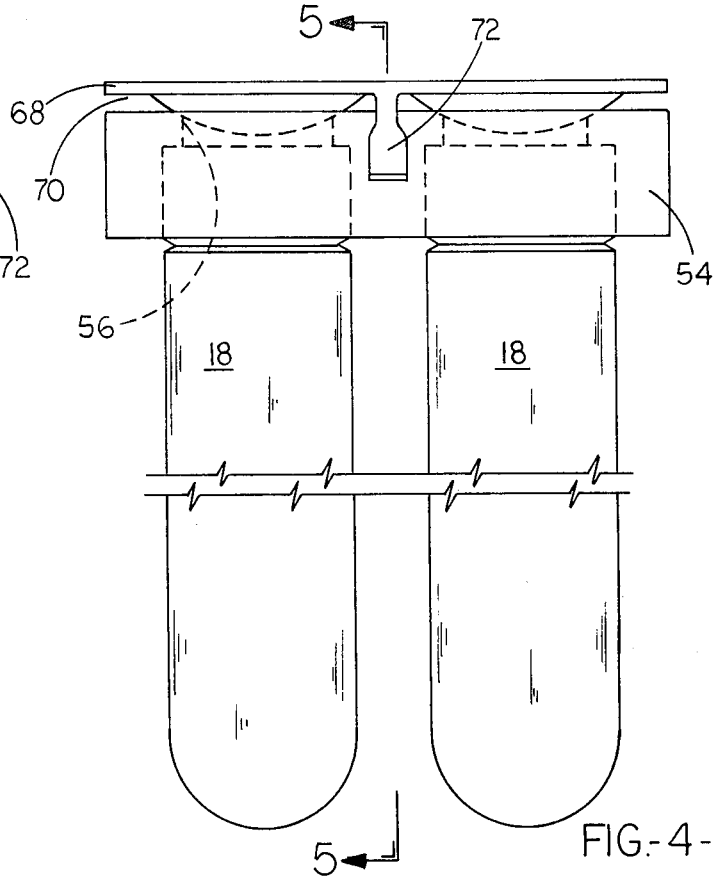
FIG. 4 is an elevation view of another embodiment of my invention.

The Embodiment of FIGS. 4 and 5

As shown in FIGS. 4 and 5, the top 52 has a body 54 with openings 56 therein similarly threaded at 58 to retain the test tube 18. Again depressed sealing surfaces 64 around the openings 56 are sealed by a dished sealing diaphragm 66 carried on the cap 68. In this embodiment, however, there is a clearance 70 around the diaphragm 66 and below the cap 68 to enable the escape of gases when the diaphragms are forced away from the sealing surface 64. A similar latch 72 holds the cap in closed position covering both openings 56 simultaneously.

Figure 6:
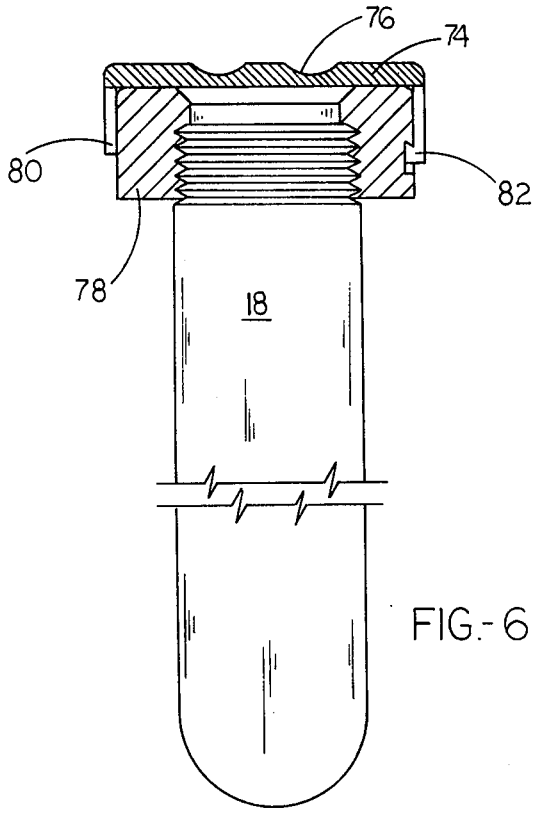
FIG. 6 is a vertical section view of still another embodiment of this invention.

The Embodiment of FIG. 6

In FIG. 6, the circular disc cover 74 has a circular groove 76 formed therein to render it more flexible and enable it to flex away from the top 78 and allow gases to escape laterally under the circular disc 74. A hinge tab 80 and a locking tab 82 diametrically positioned enable the unskirted circular cap to be secured in place.

While this invention has been described in conjunction with preferred embodiments thereof, it is obvious that modifications and changes therein may be made by those skilled in the art without departing from the spirit and scope of this invention as defined by the claims appended hereto.

What is claimed as invention is:

1. A vented top for a test media container comprising:

a holder body adapted to be grasped in the hand;

a pair of openings through said body;

means in each of said openings for gripping a laboratory test media container therein:

a cap hingedly carried on said body for pivotal movement between a closed position covering said pair of openings and an open position displaced therefrom to enable access thereto;

means on said cap for sealing off said openings in isolation from each other; and venting means on said cap for each of said openings enabling the release of gases from said each opening to the exterior.

2. The vented top defined by claim 1 wherein said venting means comprises:

flexible diaphragm portions on said cap;

each of said diaphragm portions being normally sealed around one of said opening but being flexed away therefrom by gas pressure.

3. The vented top defined by claim 2 including:

exhaust passages through said body from adjacent said openings to the exterior of said body; and a plug on each of said diaphragm portions normally received in one of said exhaust passages.

4. The vented top defined by claim 1 including:

an upright barrier extending across said body intermediate said openings;

said cap being in gas tight sealing engagement around said body and with and along said barrier when in said closed position;

said venting means comprising;

an opening through said cap on each side of said barrier;

a flap member hinged to said body adjacent each of said openings when said cap is in closed position; and a plug on each of said flap members receivable in said each opening.

5. The vented top defined by claim 1 including:

a deflector member on said body adjacent within one of said openings at one side thereof and extending partially thereacross to restrain exit of liquids and gels therefrom.

* * * * *